US006359397B1

(12) United States Patent
Aoki

(10) Patent No.: US 6,359,397 B1
(45) Date of Patent: Mar. 19, 2002

(54) DEFLECTION YOKE AND COLOR CATHODE RAY TUBE RECEIVER USING SAME

(75) Inventor: Kyousuke Aoki, Fukushima (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/713,334

(22) Filed: Nov. 16, 2000

(51) Int. Cl.[7] ..... G09G 1/28

(52) U.S. Cl. ..... 315/368.11; 315/364; 315/368.25; 315/368.27; 315/400

(58) Field of Search ..... 315/364, 368.11, 315/368.25, 368.27, 368.28, 370, 371, 382, 399, 400

(56) References Cited

U.S. PATENT DOCUMENTS 5,070,280 A * 12/1991 Okuyama et al. ..... 315/368.11
5,142,205 A * 8/1992 Yabase et al. ..... 315/368.26
5,260,627 A * 11/1993 Yokota et al. ..... 315/400
6,215,257 B1 * 4/2001 Choe ..... 315/368.28

* cited by examiner

*Primary Examiner*—Don Wong
*Assistant Examiner*—Tuyet T. Vo
(74) *Attorney, Agent, or Firm*—Ronald P. Kananen

(57) ABSTRACT

In a deflection yoke for use in a color cathode ray tube receiver, two sets of sextuple pole coils formed of bifilar windings are disposed around the orbits of three electron beams emitted from an electron gun of a cathode ray tube. Horizontal-period parabolic currents produced in a bridge circuit consisting of saturable reactors are caused to flow in such sextuple pole coils. Further the parabolic currents are modulated at the vertical period by the saturable reactor. Then sextuple-pole magnetic fields are generated by the modulated parabolic currents to thereby exert vertical force on the three electron beams, hence realizing proper correction of ΔVCR to consequently optimize the balance between the corners and the center of a screen. Such optimization is conventionally difficult due to some restrictions existing in the winding distribution of a vertical deflection coil and a horizontal deflection coil in relation to convergence and focus of side beams.

10 Claims, 10 Drawing Sheets

WHEN DEFLECTED ALONG Y-AXIS

WHEN DEFLECTED TOWARD CORNER

MAGNETIC FIELDS VIEWED FROM FRONT OF CRT

← MAGNETIC FIELD OF SEXTUPLE POLE COIL 30

--→ MAGNETIC FIELD OF SEXTUPLE POLE COIL 31

MODULATING CURRENT (Iv1)

SEXTUPLE POLE CURRENT (IA)

MODULATING CURRENT (Iv2)

SEXTUPLE POLE CURRENT (IB)

COMPOSITE CURRENT (VIRTUAL) (IA-IB)

(VIEW FROM FRONT OF CRT)

(VIEW FROM FRONT OF CRT)

DEFLECTION YOKE AND COLOR CATHODE RAY TUBE RECEIVER USING SAME

BACKGROUND OF THE INVENTION

The present invention relates to a deflection yoke and a color cathode ray tube receiver using such a yoke, and more particularly to those equipped with a convergence corrector for correcting misconvergence of a color cathode ray tube employed in a television receiver, a display monitor or the like.

In a color cathode ray tube, a color picture is displayed on its screen by vertically and horizontally deflecting the forward directions of three electron beams emitted from an electron gun.

For deflection of electron beams, there is used a deflection yoke having a horizontal deflection coil and a vertical deflection coil.

In a cathode ray tube, a deflection yoke is installed in one region termed a cone which is defined from a neck of the tube to a funnel thereof.

A horizontal deflection current and a vertical deflection current are caused to flow, respectively, in a horizontal deflection coil and a vertical deflection coil on the orbits of three electron beams emitted from the electron gun, thereby forming deflection magnetic fields. The electron beams are deflected vertically and horizontally by such deflection magnetic fields.

In the color cathode ray tube, three electron beams emitted from its electron gun are converged on one point of a fluorescent screen via color selection electrodes of an aperture grill or a shadow mask, whereby a desired color picture is reproduced on the screen.

In this case, if there occurs misconvergence where the three electron beams fail to be converged on one point of the fluorescent screen, it causes some color deviation or color phase irregularity.

Generally, in any color cathode ray tube having an in-line type electron gun where a center electron beam G for lighting a green fluorescent layer and side electron beams R, B for lighting red and blue fluorescent layers are arranged in a line, misconvergence shown in FIG. 1 occurs on the screen when the vertical deflection magnetic field is a uniform one.

In this example, a red side beam R deviates leftward, while a blue side beam B deviates rightward.

It is widely known that this misconvergence can be corrected by forming the vertical deflection magnetic field into a barrel shape.

More specifically, there is generally performed a technique of adjusting the winding distribution of a vertical deflection coil to thereby form the vertical deflection magnetic field into a barrel shape .

However, if the vertical deflection magnetic field is formed into a barrel shape, there occurs another misconvergence in a vertical direction, as shown in FIG. 2A.

In case such vertical misconvergence is existent, the difference between the average value of the side beams R, B and the center beam G is termed VCR (Vertical Center Raster).

It is possible to achieve static correction of this VCR by means of adding, for example, some magnetic member to the electron gun.

Practically, however, the VCR is not always fixed in dimension, and there may arise some difference between the VCR at the t op and bottom of the screen along the Y-axis thereof, i.e., at the screen center, and the VCR at the horizontal top and bottom ends of the screen, i.e., at the screen corners.

For example, there may remain a pattern of FIG. 2B where the beam G is outside at the screen center, while the beam G is inside at the screen corners.

It is supposed here that the difference between the raster VCR at the screen center and the raster VCR at the screen corner is termed ΔVCR.

In order to change such ΔVCR, the following two measures may be adopted for example.

The first measure is carried out by adjusting the winding distribution of the vertical deflection coil to thereby balance the screen corner and the screen center.

The second measure is carried out by utilizing that a horizontal deflection magnetic field that affects the raster VCR at the screen corner.

More concretely, the screen corner and the screen center are balanced by adjusting the winding distribution of the horizontal deflection coil.

Now a consideration will be given below on the force exerted on the center beam G and the side beams R, B by the vertical deflection magnetic field in a barrel shape.

It is supposed that the magnetic fields exerted respectively on the in-line center beam G and side beams R, B are in the directions indicated by arrows in FIG. 3.

FIG. 3A shows an example where the electron beams are deflected upward along the Y-axis of the screen, and FIG. 3B shows another example where the electron beams are deflected toward the upper right end of the screen corner.

The horizontal component of the magnetic field exerted on each electron beam, i.e., the magnetic field for vertical deflection, can be changed by adjusting the winding distribution of the vertical deflection coil.

It is also possible to change the magnetic fields separately at the screen center and the screen corners to a certain extent.

However, if the horizontal component of the vertical deflection magnetic field is changed by adjusting the winding distribution of the vertical deflection coil, the vertical component of the vertical deflection magnetic field is also changed simultaneously therewith.

For this reason, if the winding distribution of the vertical deflection coil is altered, the horizontal convergence is affected as observed in the HCR (Horizontal Center Raster) which represents the difference between the average value of the side beams R, B and the center beam G.

Also in the case of adjustment by the winding distribution of the horizontal deflection coil, the concept is still the same although the direction of the magnetic field is different, and therefore it is possible to change ΔVCR at the screen corner, but such adjustment affects the vertical convergence.

Further, any change of the magnetic fields affects the focus characteristics of electron beams as well as the convergence characteristics thereof.

Thus, in either of the first and second measures mentioned above, there exist some restrictions relative to the winding distribution in connection with the convergence or focus of the side beams R and B.

It is therefore difficult to optimize ΔVCR by altering the winding distribution of the vertical deflection coil or the horizontal deflection coil.

SUMMARY OF THE INVENTION

The present invention has been accomplished in view of the problems described above. It is an object of the invention to provide a deflection yoke and a color cathode ray tube receiver using such a yoke equipped with a convergence corrector which is capable of correcting ΔVCR independently to thereby achieve proper convergence with high precision.

According to one aspect of the present invention, there is provided a deflection yoke which comprises parabolic current producing means for producing a horizontal-period parabolic current and then supplying the parabolic current to a convergence correcting coil; sextuple-pole magnetic field generating means disposed around the orbits of three electron beams emitted from an electron gun, and exerting vertical force on the three electron beams by a sextuple-pole magnetic field generated in accordance with the horizontal-period parabolic current supplied from the parabolic current producing means; and saturable reactor means for modulating, by a vertical-period current, the horizontal-period parabolic current flowing in the sextuple-pole magnetic field generating means.

This deflection yoke is installed in a cone region of a cathode ray tube employed in a color cathode ray tube receiver.

In the deflection yoke having the above structure and a color cathode ray tube receiver using such deflection yoke, a horizontal-period parabolic current produced in the parabolic current producing means is caused to flow in the convergence correcting coil, so that any misconvergence is corrected by a correcting magnetic field generated by the convergence correcting coil.

The horizontal-period parabolic current is caused to flow also in the sextuple-pole magnetic field generating means.

Consequently, the sextuple-pole magnetic field generating means generates a sextuple-pole magnetic field in accordance with the horizontal-period parabolic current, and exerts vertical force on three electron beams by the sextuple-pole magnetic field.

In this case, the saturable reactor means modulates, by the vertical-period current, the horizontal-period parabolic current flowing in the sextuple-pole magnetic field generating means.

As a result, the horizontal-period parabolic current modulated at the vertical period is caused to flow in the sextuple-pole magnetic field generating means.

The above and other features and advantages of the present invention will become apparent from the following description which will be given with reference to the illustrative accompanying drawings.

DETAILED DESCRIPTION OF PREFERRED EMBODIMENTS

Hereinafter some preferred embodiments of the present invention will be described in detail with reference to the accompanying drawings.

Figure 4:
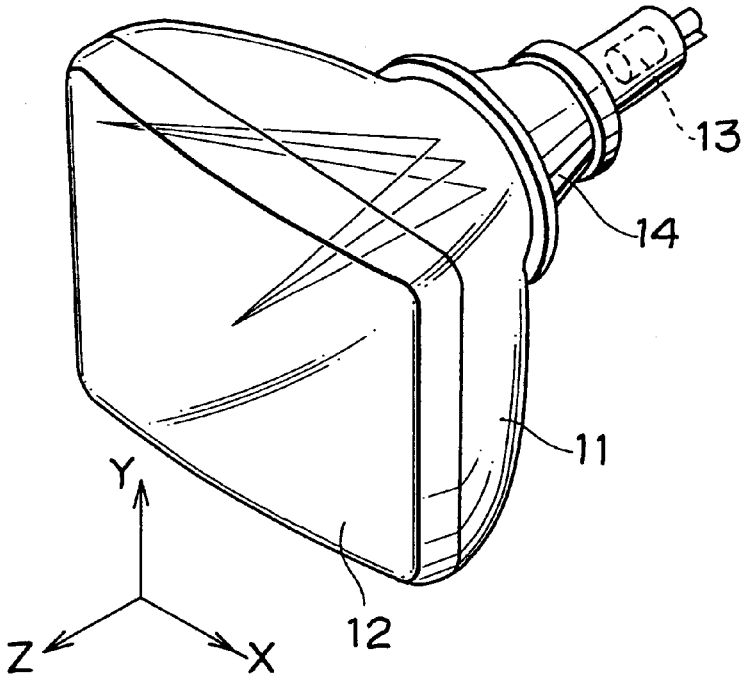
FIG. 4 is a schematic perspective view showing the whole of a color cathode ray tube where the present invention is applied.

FIG. 4 perspectively shows the whole of a color cathode ray tube where the present invention is applied.

In FIG. 4, a panel 12 having a fluorescent screen on its inner face is attached to the front portion of a picture tube 11, and an electron gun 13 for emitting electron beams therefrom is enclosed in a rear end portion of the picture tube 11.

Further a cone-shaped deflection yoke 14 for deflecting the electron beams emitted from the electron gun 13 is attached to a neck of the picture tube 11.

Figure 5:
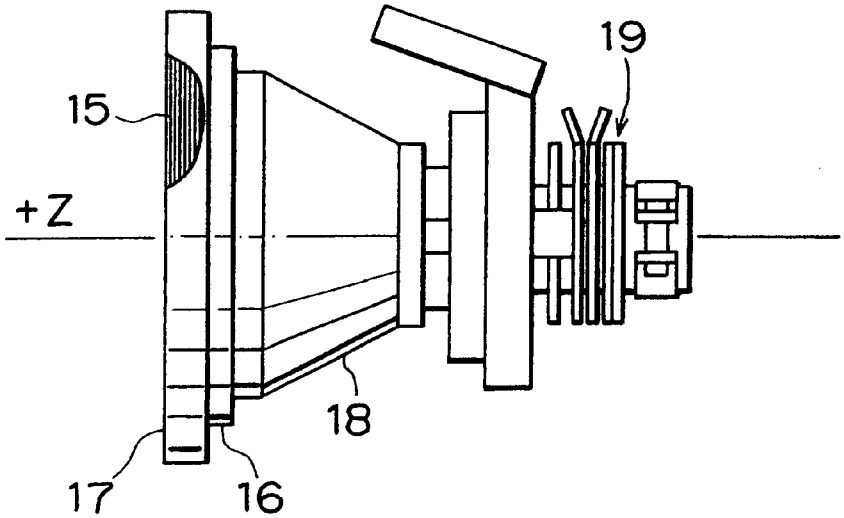
FIG. 5 is a partly sectional side view of a deflection yoke where the present invention is applied.

FIG. 5 is a partly sectional side view of the deflection yoke 14 according to the present invention.

As obvious from FIG. 5, the deflection yoke 14 is equipped with such component members as a horizontal deflection coil 15, a vertical deflection coil 16, a coil bobbin 17, a core 18 and a ring magnet 19.

The horizontal deflection coil 15 and the vertical deflection coil 16 serve to deflect the electron beams, which have been emitted from the electron gun 13, leftward/rightward (in horizontal direction) and upward/downward (in vertical direction), respectively.

These deflection coils 15 and 16 are installed in the cone-shaped coil bobbin 17.

More specifically, the horizontal deflection coil 15 is positioned on the inner peripheral side of the coil bobbin 17, while the vertical deflection coil 16 is positioned on the outer peripheral side of the coil bobbin 17.

The core 18 is composed of ferrite, and is so installed as to cover the deflection coils 15 and 16 for further enhancing the efficiency of magnetic fields generated from the deflection coils 15 and 16.

The ring magnet 19 is provided in the neck of the deflection yoke 14 for correcting any assembly error of the electron gun 13.

Figure 6:
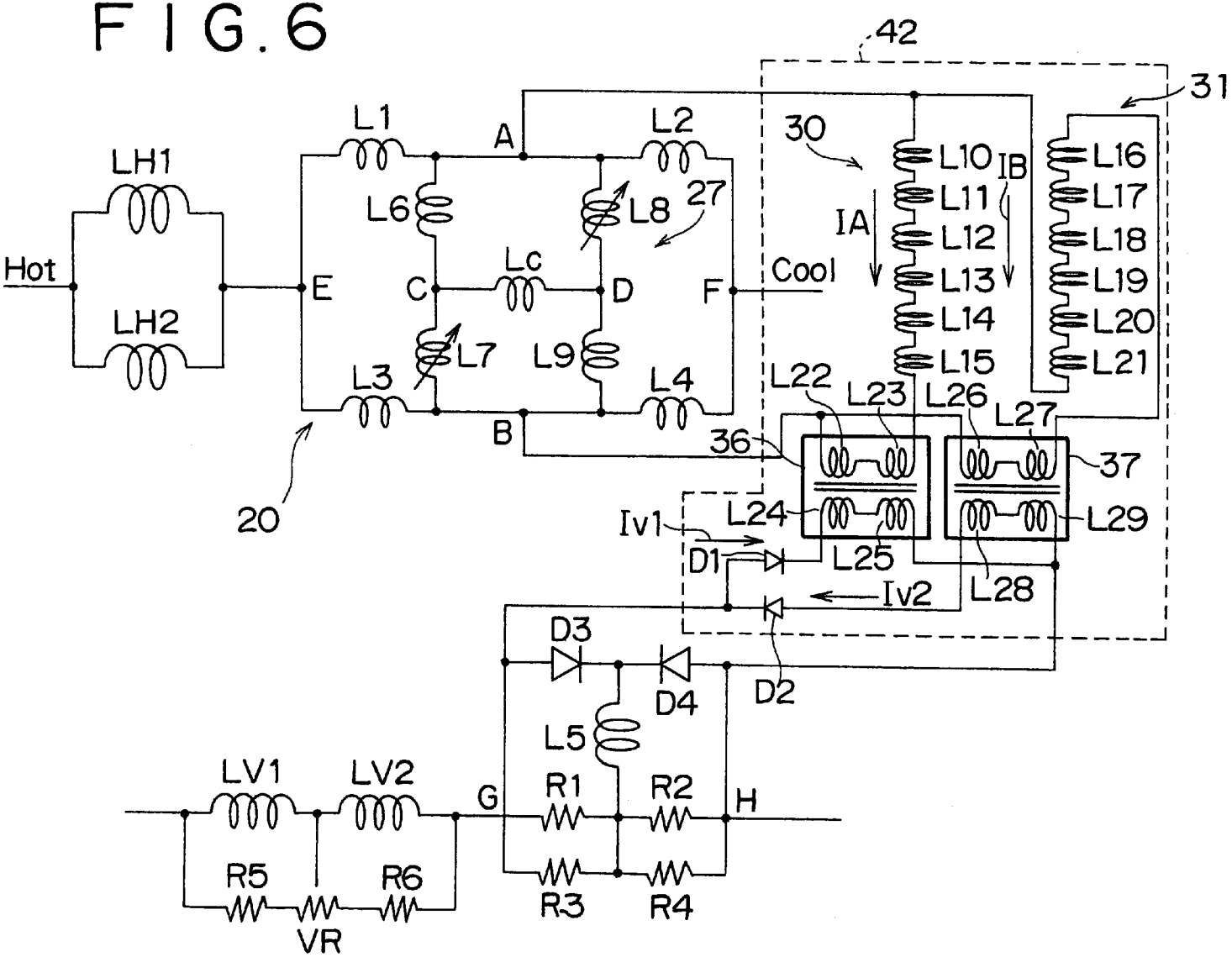
FIG. 6 is a circuit diagram showing a structural example of a convergence corrector installed in the deflection yoke where the present invention is applied.

FIG. 6 is a circuit diagram showing a structural example of a convergence corrector installed in the deflection yoke 14.

In FIG. 6, series-connected coils L1, L2 and similar series-connected coils L3, L4 are bridge-connected in parallel to each other to thereby constitute a first bridge circuit 20.

Figure 7:
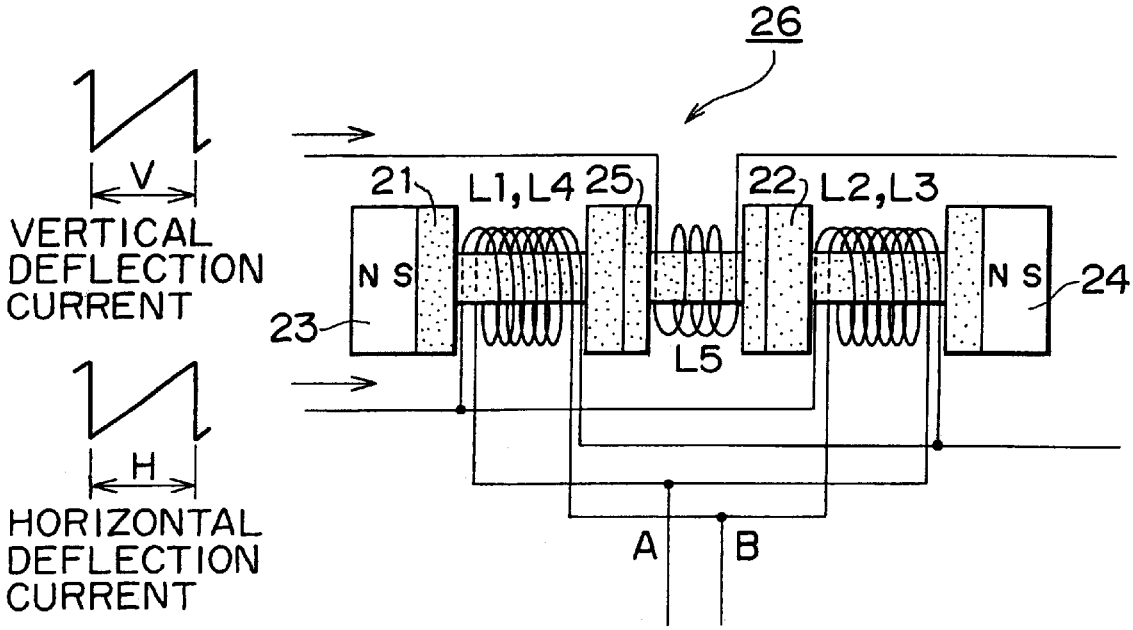
FIG. 7 shows an exemplary structure of a saturable reactor employed in the present invention.

Out of these two sets of coils, the coils L1, L4 and the coils L2, L3 constitute a saturable reactor 26, as shown in FIG. 7.

Now the structure of this saturable reactor 26 will be described below with reference to FIG. 7.

The coils L1, L4 and the coils L2, L3 are wound around two drum cores 21, 22, respectively.

These coils may be so wound as to form bifilar windings.

If a plurality of wires are wound simultaneously to form bifilar windings, the winding states of the coils L1, L4 and the coils L2, L3 are mutually equalized so that substantially equal magnetic characteristics can be achieved in such two pairs of coils.

The coils L1, L4 and the coils L2, L3 are wound in different directions so as to generate magnetic fields of mutually reverse directions.

Two permanent magnets 23, 24 are disposed outside the two drum cores 21, 22 in such a manner that fixed bias magnetic fields are impressed from the two permanent magnets 23, 24 to the coils L1, L4 and the coils L2, L3.

In this embodiment, the permanent magnet 23 is so disposed as to operate the drum core 21 as S pole, while the permanent magnet 24 is so disposed as to operate the drum core 22 as N pole.

Between the two drum cores 21 and 22, there is provided another drum core 25 which is similar in shape.

A modulating coil L5 is wound around the drum core 25. This modulating coil L5 impresses a magnetic field, which corresponds to the current flowing in the coil L5, to the coils L1 to L4.

The saturable reactor 26 has the structure mentioned above.

As will be described later, the saturable reactor 26 functions as means to generate a horizontal deflection-period parabolic current modulated at the vertical deflection period.

In the first bridge circuit 20 consisting of the coils L1 to L4 shown in FIG. 6, coils L6, L7 and coils L8, L9 are connected in series, respectively, between output terminals of the bridge circuit 20, i.e., between a common junction A of the coils L1, L2 and a common junction B of the coils L3, L4.

These four coils, i.e., the coils L6, L7 and the coils L8, L9, constitute a second bridge circuit 27.

Further, a convergence correcting coil Lc is connected between output terminals of the second bridge circuit 27, i.e., between a common junction C of the coils L6, L7 and a common junction D of the coils L8, L9.

Figure 8:
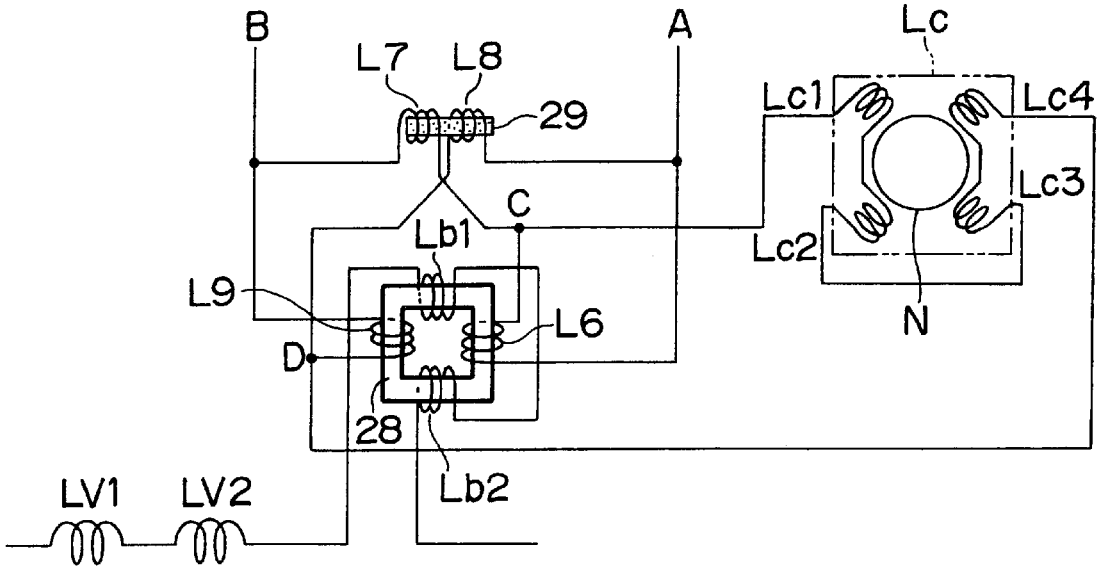
FIG. 8 is a connection diagram showing an exemplary structure of individual coils and a convergence correcting coil which constitute a second bridge circuit employed in the present invention.

FIG. 8 shows an exemplary structure of the coils L6 to L9 and the convergence correcting coil Lc.

The coils L6 and L9 are wound around a core 28 which forms a closed magnetic circuit.

Further, bias coils Lb1 and Lb2 are also wound around the core 28.

And a vertical deflection current flows in the bias coils Lb1, Lb2 via vertical deflection coils LV1, LV2 which will be described later.

Meanwhile, the coils L7, L8 are wound around a coil bobbin (not shown) in a manner to form, e.g., bifilar windings.

The inductance is rendered variable by shifting a core 29 inward or outward with regard to the bobbin.

The convergence correcting coil Lc consists of four split coil members Lc1 to Lc4.

These four coil members Lc1 to Lc4 are positioned at an angular interval of 90° around the neck N of the color cathode ray tube.

In FIG. 6, the convergence correcting coil Lc is shown simply as a single coil.

Further, one end of each of sextuple-pole coils 30, 31 is connected to the output terminal A of the bridge circuit 20.

The sextuple pole coil 30 consists of six series connected coils L10 to L15 and is connected, at an open end of the coil L10, to the output terminal A of the bridge circuit 20.

Also the other sextuple pole coil 31 consists of six series-connected coils L16 to L21 and is connected, at an open end of the coil L21, to the output terminal A of the bridge circuit 20.

Figure 9:
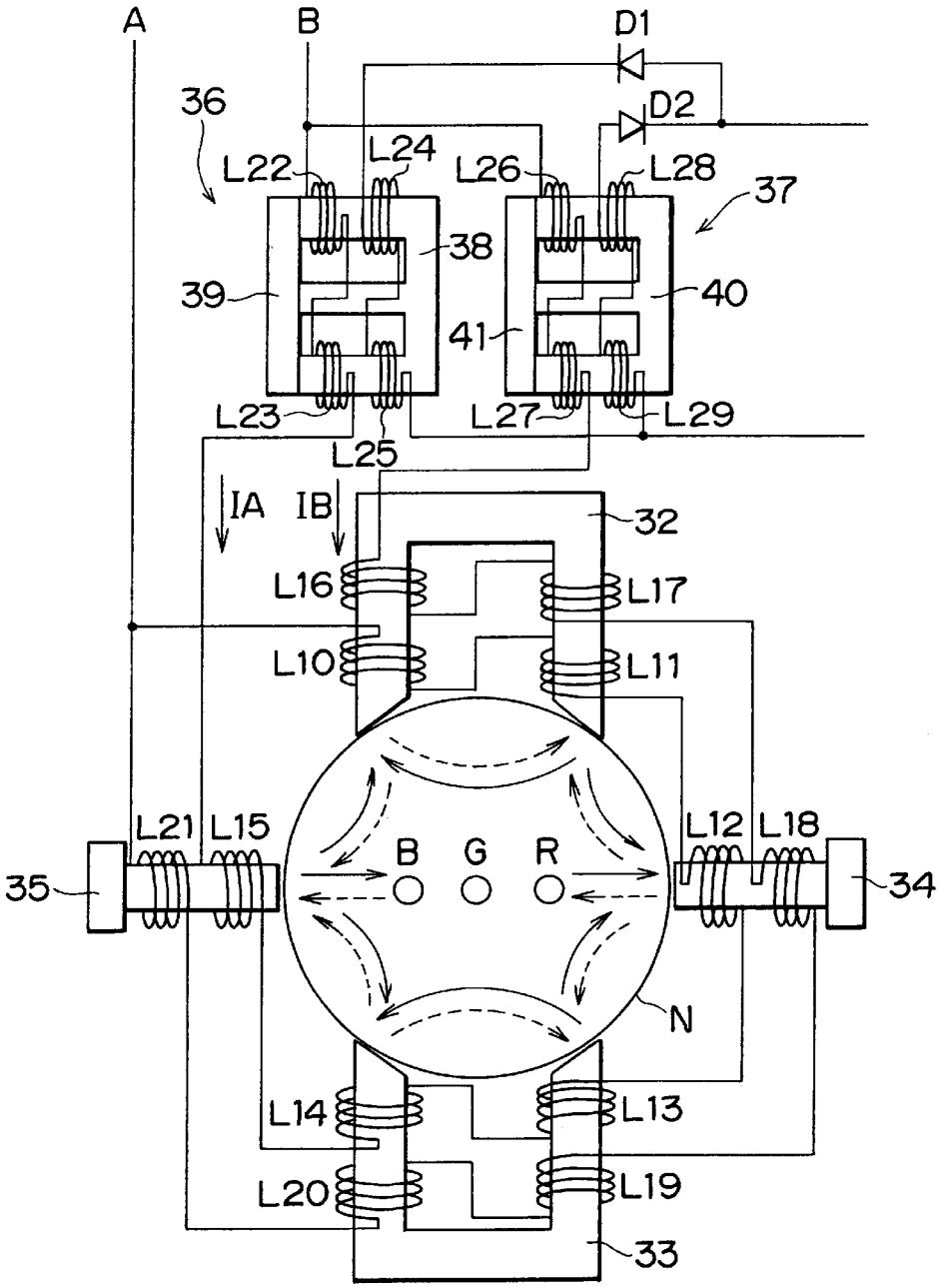
FIG. 9 is a connection diagram showing a structural example of two sets of sextuple-pole coils and two saturable reactors employed in the present invention.

As shown in FIG. 9, the respective coils L10 to L15 and L16 to L21 of the sextuple-pole coils 30 and 31 are disposed in the periphery of the neck N of the color cathode ray tube.

More specifically, in the periphery of the neck N of the color cathode ray tube, substantially C-shaped cores 32, 33 are disposed in the vertical direction on both sides of the neck N, while substantially I-shaped cores 34, 35 are disposed in the horizontal direction on both sides of the neck N. The coils L10 to L15 and L16 to L21 are wound around such cores respectively.

The sextuple-pole coil 30 is so structured that the coils L10, L11 are wound around legs of the core 32, the coil L12 is wound around the core 34, the coils L13, L14 are wound around legs of the core 33, and the coil L15 is wound around the core 35 respectively in this order.

Similarly, the sextuple pole coil 31 is so structured that the coils L16, L17 are wound around legs of the core 32, the coil L18 is wound around the core 34, the coils L19, L20 are wound around legs of the core 33, and the coil L21 is wound around the core 35 respectively in this order.

Each component coil of the sextuple-pole coil 30 and each component coil of the sextuple-pole coil 31 are wound to form bifilar windings.

The coils L10, L11 and the coils L16, L17 are wound around the core 32 in such a manner as to generate, between the end faces of the legs thereof according to the current directions, magnetic fields in the directions indicated by arrows of solid and dotted lines in the diagram.

Similarly, the coils L13, L14 and the coils L19, L20 are wound around the core 33 in such a manner as to generate, between the end faces of the legs thereof, magnetic fields in the directions indicated by arrows of solid and dotted lines in the diagram.

Meanwhile, the coils L12, L18 and the coils L15, L21 are wound around the cores 34 and 35 respectively in such a manner as to generate horizontal magnetic fields indicated by arrows of solid and dotted lines in the diagram.

In FIG. 9, each arrow of the solid and dotted lines indicates the direction of the relevant magnetic field seen from the front of the color cathode ray tube.

The solid-line arrows represent the sextuple-pole magnetic field generated by the sextuple-pole coil 30, and the dotted-line arrows represent the sextuple-pole magnetic field generated by the sextuple pole coil 31.

Meanwhile, the ends of coils on one side of saturable reactors 36 and 37 are connected to the output terminal B of the bridge circuit 20.

As shown in FIG. 9, the saturable reactor 36 comprises an E-shaped core 38; coils L22, L23 wound around the end legs of the core 38 and connected in series to each other; coils L24, L25 wound around the end legs of the core 38 and connected in series to each other; and an I-shaped core 39 attached to the end face of each leg of the core 38.

Similarly to the saturable reactor 36 mentioned above, the saturable reactor 37 comprises an E-shaped core 40; coils L26, L27 wound around the end legs of the core 40 and connected in series to each other; coils L28, L29 wound around the end legs of the core 40 and connected in series to each other; and an I-shaped core 41 attached to the end face of each leg of the core 40.

As shown in FIGS. 6 and 9, each open end of the coils L22, L26 in the saturable reactors 36, 37 is connected to the output terminal B of the bridge circuit 20.

The open end of the coil L23 is connected to the open end of the coil L15 in the sextuple-pole coil 30, and the open end of the coil L27 is connected to the open end of the coil L16 in the sextuple-pole coil 31.

Further, the open end of the coil L24 is connected to the cathode of a diode D1, and the open end of the coil L28 is connected to the anode of a diode D2.

The saturable reactors 36, 37 of the above structure are so set that, when a current is caused to flow in the modulation-side coils L24, L25 and L28, L29, the inductance of each of the coils L22, L23 and L26, L27 is reduced.

As will be described later, a vertical-period current is supplied to the coils L24, L25 and the coils L28, L29.

The aforementioned sextuple-pole-coils 30, 31, saturable reactors 36, 37 and diodes D1, D2 constitute a circuit 42 for correction of ΔVCR.

In FIG. 6 again, the cathodes of diodes D3, D4 are connected in common to each other, and the anode of the diode D1 and the cathode of the diode D2 are connected in common to the anode of the diode D3.

Meanwhile, the open ends of the coils L25, L29 in the saturable reactors 36, 37 are connected in common to the anode of the diode D4.

Further, series-connected resistors R1, R2 and series-connected resistors R3, R4 are connected in parallel respectively to the series-connected diodes D3, D4.

The modulating coil L5 of the aforementioned saturable reactor 26 is connected between the cathode common junction of the diodes D3, D4 and the common junctions of the resistors R1, R2 and R3, R4.

Horizontal deflection coils LH1, LH2 connected in parallel to each other correspond to the horizontal deflection coil 15 in the deflection yoke 14 shown in FIG. 5.

Vertical deflection coils LV1, LV2 connected in series to each other correspond to the vertical deflection coil 16 in the deflection yoke 14 shown in FIG. 5.

A resistor R5, a variable resistor VR and a resistor R6, which are connected in series to one another, are connected in parallel to the vertical deflection coils LV1, LV2.

The slide contact of the variable resistor VR is connected to the common junction of the vertical deflection coils LV1, LV2.

A horizontal-period sawtooth current (horizontal deflection current) is supplied from a horizontal deflection circuit (not shown) to the horizontal deflection coils LH1, LH2.

Meanwhile, a vertical-period sawtooth current (vertical deflection current) is supplied from a vertical deflection circuit (not shown) to the vertical deflection coils LV1, LV2.

Consequently, a horizontal deflection magnetic field and a vertical deflection magnetic field are formed on the orbits of electron beams, and the electron beams are deflected by such deflection magnetic fields.

The horizontal deflection current flows between input terminals of the bridge circuit 20, which consists of coils L1 to L5, via the horizontal deflection coils LH1, LH2, i.e., between a common junction E of the coils L1, L3 and a common junction F of the coils L2, L4.

Meanwhile, the vertical deflection current flows between input terminals G, H of the circuit consisting of the modulating coil L5, diodes D3, D4 and resistors R1 to R4, via the vertical deflection coils LV1, LV2.

Next, a description will be given on the circuit operation of the convergence corrector having the above-mentioned structure.

First, the circuit operation of the saturable reactor 26 including the bridge circuit 20 of coils L1 to L4 will be described with reference to an explanatory principle diagram of FIG. 10.

Figure 10:
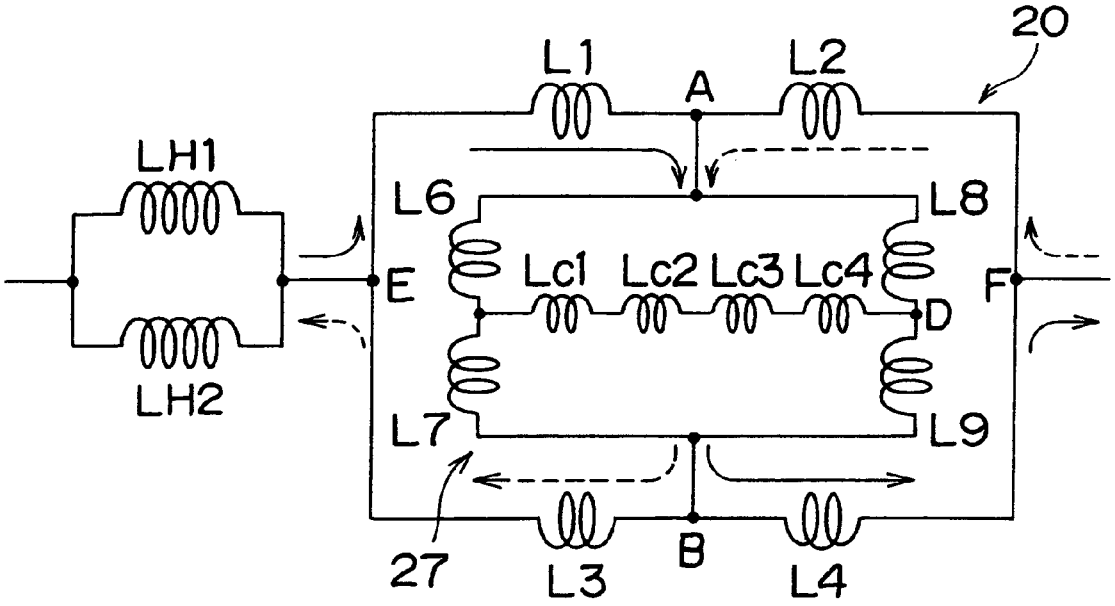
FIG. 10 is an explanatory diagram for explaining the principle of operation of a saturable reactor including a first bridge circuit employed in the present invention.

Suppose now that, when a sawtooth horizontal deflection current has been supplied between the two input terminals of the first bridge circuit 20, i.e., between the common junction E of the coils L1, L3 and the common junction F of the coils L2, L4 via the horizontal deflection coils LH1, LH2, the current flows into the input terminal E as indicated by a solid-line arrow in FIG. 10. Then, magnetic fields directionally identical with the fixed bias magnetic field are generated by the coils L1, L4, while magnetic fields directionally reverse to the bias magnetic field are generated by the coils L2, L3.

In this case, the magnetic fields derived from the coils L1, L4 are increased since the magnetic fields generated in accordance with the horizontal deflection current are directionally identical with the fixed bias magnetic field.

Consequently, the magnetic saturation of the core 21 tends to be higher in FIG. 7, thereby reducing the inductances of the coils L1, L4.

Meanwhile, the magnetic fields derived from the coils L2, L3 are decreased since the magnetic fields generated in accordance with the horizontal deflection current are directionally reverse to the fixed bias magnetic field.

Consequently, the magnetic saturation of the core 23 tends to be lower in FIG. 7, thereby increasing the inductances of the coils L2, L3.

As a result, the current delivered via the input terminal E comes to flow into one coil of the smaller inductance.

More specifically, in case the deflection current is delivered via the input terminal E as indicated by a solid-line arrow in FIG. 10, this current first flows through the coil L1 and then flows from the output terminal A into the second bridge circuit 27 consisting of coils L6 to L9.

Subsequently this current flows through the bridge circuit 27 and, after flowing out from the output terminal B, the current further flows out to an external device from the other input terminal F via the coil L4.

Meanwhile, in case the deflection current flows into the input terminal F as indicated by a dotted-line arrow in FIG. 10, magnetic fields directionally reverse to the fixed bias magnetic field are generated by the coils L1, L4, while magnetic fields directionally identical with the bias magnetic field are generated by the coils L2, L3.

In this case, the magnetic fields derived from the coils L1, L4 are decreased since the magnetic fields generated in accordance with the horizontal deflection current are directionally reverse to the fixed bias magnetic field.

Consequently, the inductances of the coils L1, L4 are increased.

On the other hand, the magnetic fields derived from the coils L2, L3 are increased since the magnetic fields generated in accordance with the horizontal deflection current are directionally identical with the fixed bias magnetic field.

Consequently, the inductances of the coils L2, L3 are decreased.

As a result, the current delivered via the input terminal F comes to flow into one coil of the smaller inductance, as in the foregoing case.

More specifically, in case the deflection current is delivered via the input terminal F as indicated by a dotted-line arrow in FIG. 10, this current first flows through the coil L2 and then flows from the output terminal A into the second bridge circuit 27 consisting of coils L6 to L9.

Subsequently this current flows through the bridge circuit 27 and, after flowing out from the output terminal B, the current further flows out to an external device from the other input terminal E via the coil L3.

In this manner, the current flows in the same direction (indicated by the arrow in the diagram) in the second bridge circuit 27 of four coils L6 to L9, regardless of the direction of the current flowing in the bridge circuit 20 of coils L1 to L4.

Therefore, the waveform of this current is rendered approximately parabolic.

That is, the first bridge circuit 20 consisting of the coils of the saturable reactor 26 shown in FIG. 7 generates a horizontal parabolic current in compliance with a flow of the horizontal-period sawtooth current.

This horizontal parabolic current flows through the bridge circuit 27 of coils L6 to L9.

Meanwhile, when the vertical deflection current flows in the bias coils Lb1, Lb2 via the vertical deflection coils LV1, LV2 in FIG. 8, the coils Lb1, Lb2 generate, in the core 28, a bias magnetic field corresponding to the vertical deflection current.

Then the inductances of the coils L6, L9 wound around the core 28 are affected and changed by such a bias magnetic field.

More concretely, the inductances of the coils L6, L9 are reduced in accordance with an increase of the vertical deflection current.

As a result, a difference is induced between the current flowing in the coil L6 and the current flowing in the coil L9, and then the difference current flows in the convergence correcting coils Lc1 to Lc4.

In this stage, the current flowing in the convergence correcting coils Lc1 to Lc4 is modulated at the vertical deflection period to have a waveform substantially parabolic.

That is, this current becomes a parabolic one modulated at the horizontal deflection period and the vertical deflection period.

A quadrupole magnetic field is formed by the convergence correcting coils Lc1 to Lc4 in accordance with the above parabolic current.

The quadrupole magnetic field is generated merely for correction of the misconvergence between the beams R and B, and has no function for correction of ΔVCR.

Correction of ΔVCR intended in the present invention is realized by the circuit 42 shown in FIG. 6.

Now a description will be given on the circuit 42 below.

As shown in FIG. 6, the circuit 42 is connected to the output terminals A and B of the bridge circuit 20.

Therefore, the horizontal deflection-period parabolic current produced in the saturable reactor 26 flows also in the sextuple-pole coils 30, 31 and the saturable reactors 36, 37.

Meanwhile, a current Iv1 rectified by the diode D1 is supplied from a vertical deflection circuit (not shown) via vertical deflection coils LV1, LV2 to the coils L24, L25 of the saturable reactor 36.

Figure 11A:
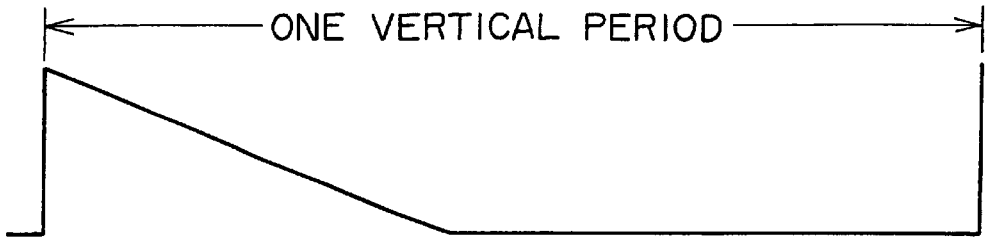
FIGS. 11A to 11E are waveform charts for explaining the operations of two sets of sextuple-pole coils and two saturable reactors employed in the present invention.

FIG. 11A shows the waveform of this current Iv1.

In the saturable reactor 36, the inductances of the coils L22, L23 are modulated due to a flow of the current Iv1 in the coils L24, L25.

In this configuration, the sextuple-pole coil 30 is connected in series to the coils L22, L23, and the inductances of these coils L22, L23 are modulated by the current Iv1, so that the horizontal parabolic current flowing in the sextuple-pole coil 30 is also modulated by the current Iv1.

Figure 11B:
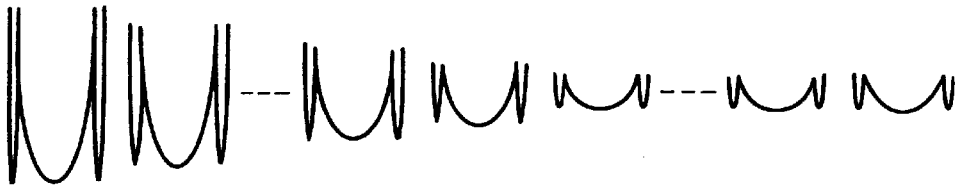

FIG. 11B shows the waveform of the horizontal parabolic current IA thus modulated.

Meanwhile in the saturable reactor 37, a current Iv2 rectified by the diode D2 is supplied to the coils L28, L29, as in the foregoing saturable reactor 36.

Figure 11C:
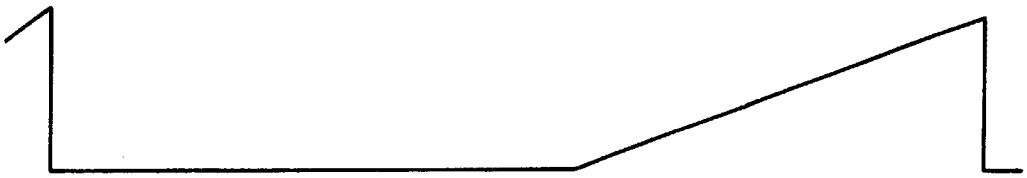

FIG. 11C shows the waveform of such current Iv2.

The inductances of the coils L26, L27 are modulated due to a flow of the current Iv2 in the coils L28, L29.

Consequently, the horizontal parabolic current flowing in the sextuple-pole coil 31 is modulated by the current Iv2.

Figure 11D:
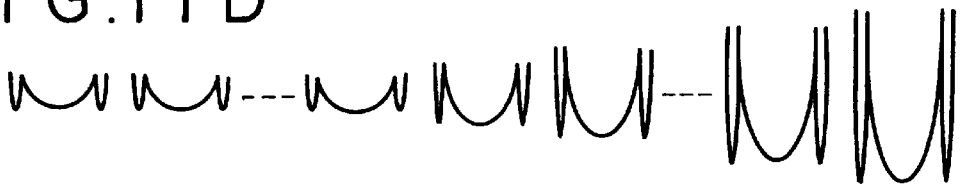

FIG. 11D shows the waveform of the horizontal parabolic current IB thus modulated.

Since the coils L10 to L15 and L16 to L21 of the sextuple-pole coils 30, 31 are formed of bifilar windings, the horizontal parabolic current IA of the waveform shown in FIG. 11B flows in the sextuple-pole coil 30, while the horizontal parabolic current IB of the waveform shown in FIG. 11D flows in the sextuple pole coil 31.

Figure 11E:
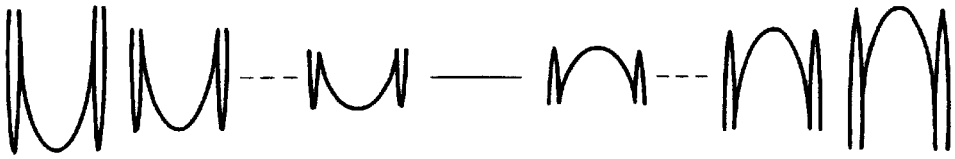

Accordingly, a composite current (IA–IB) thereof becomes a sextuple-pole current having the waveform of FIG. 11E.

When this sextuple-pole current flows in the sextuple-pole coils 30, 31, sextuple-pole magnetic fields are formed in the neck N by the sextuple-pole coils 30, 31, as shown in FIG. 9.

Figure 12:
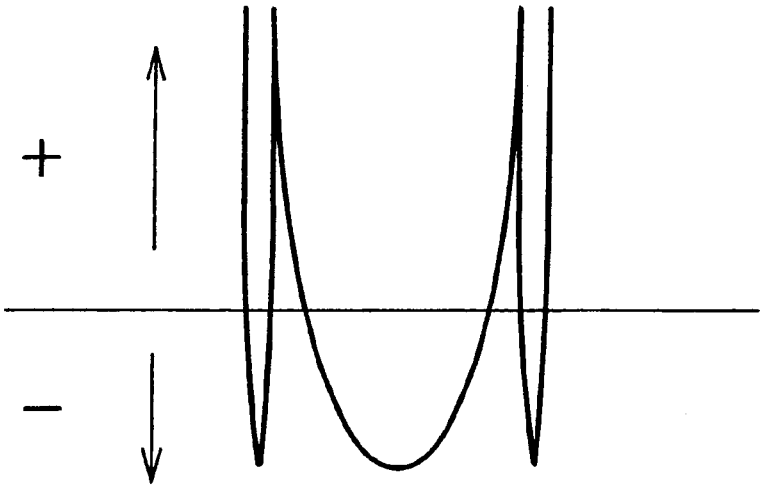
FIG. 12 is a waveform chart showing the polarity of a parabolic current in the present invention.

Regarding the correlation between the waveform of FIG. 11E and the screen, the current at the top of the screen corresponds to the left end of FIG. 11E, and the polarity of the parabolic current is assumed to be such as shown in FIG. 12.

Figure 13:
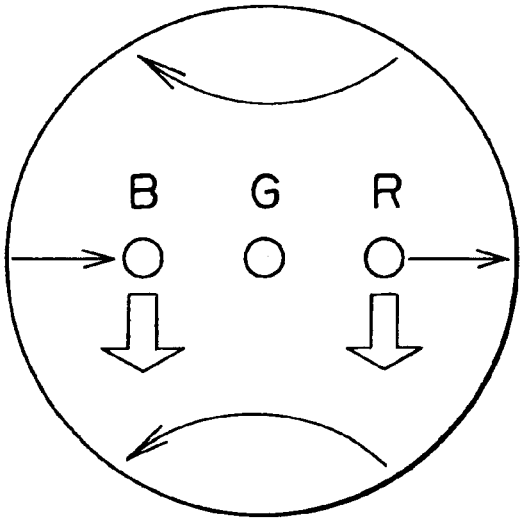
FIG. 13 shows a sextuple-pole magnetic field generated according to a positive parabolic current in a correcting circuit employed in the present invention, illustrating a state seen from the front of a cathode ray tube.
Figure 14:
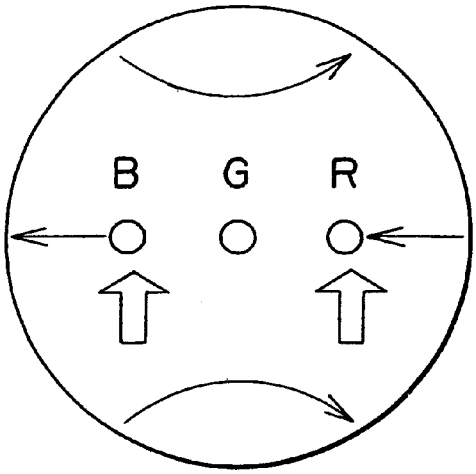
FIG. 14 shows a sextuple-pole magnetic field generated according to a negative parabolic current in the correcting circuit employed in the present invention, illustrating a state seen from the front of the cathode ray tube.

FIGS. 13 and 14 show sextuple-pole magnetic fields generated in accordance with the polarity of the parabolic current, as viewed from the screen side of the cathode ray tube.

Since a sextuple-pole current of the waveform shown in FIG. 11E flows in the sextuple-pole coils 30, 31, downward force in FIG. 13 is exerted on the side beams R. B by the horizontal magnetic field at the left and right ends of the screen top. At the screen center, the current polarity is inverted as shown in FIG. 12. Accordingly, upward force is exerted on the side beams R, B reversely to the above.

Consequently, the side beams R, B are lowered at the left and right ends of the screen top while being raised at the screen center.

Meanwhile the current at the screen bottom corresponds to the right end of FIG. 11E, so that the waveform of the parabolic current becomes reverse to the above.

Therefore, as shown in FIG. 14, upward force is exerted on the side beams R, B by the horizontal magnetic field at the left and right ends of the screen bottom. At the screen center, the current polarity is inverted as shown in FIG. 12. Accordingly, downward force is exerted on the side beams R, B reversely to the above.

Consequently, the side beams R, B are raised at the left and right ends of the screen bottom while being lowered at the screen center.

Figure 15:
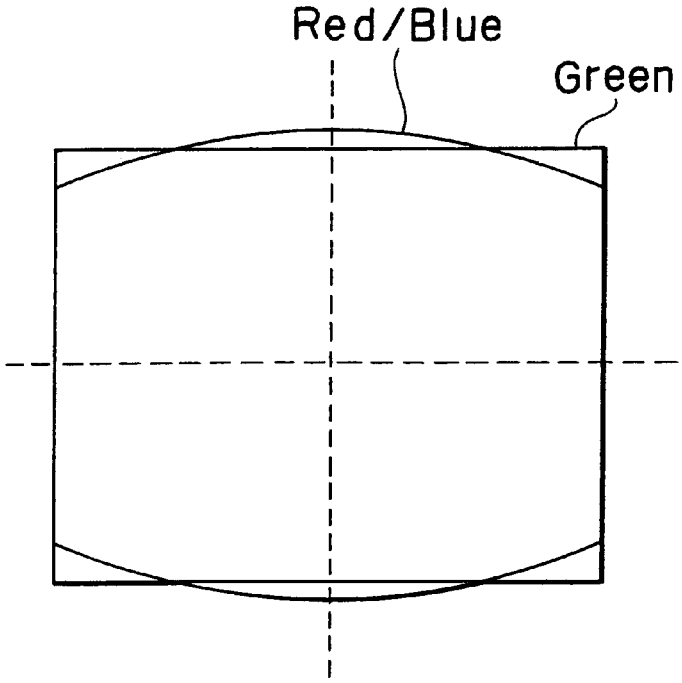
FIG. 15 shows changes of the positional relation caused between a center beam G and side beams R, B by the correcting circuit employed in the present invention, illustrating an exemplary pattern observed on the entire screen.

Since the side beams R, B are changed as described by the sextuple-pole magnetic fields produced by the sextuple-pole coils 30, 31, the side beams R, B are shifted inward at the screen corners and outward at the screen center, as shown in FIG. 15 which represents the entire screen.

Figure 1:
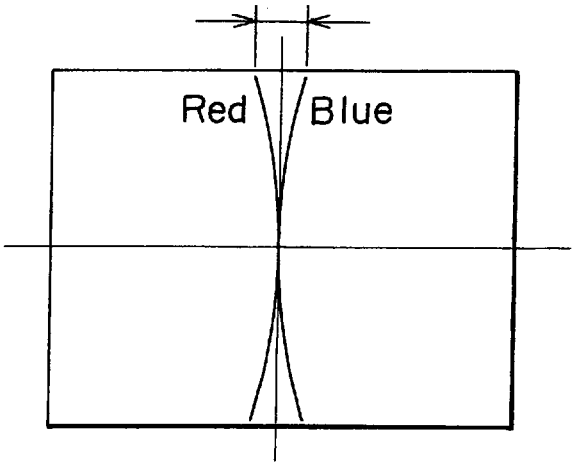
FIG. 1 is an explanatory diagram of horizontal misconvergence induced on the screen of a cathode ray tube when the vertical deflection magnetic field is a uniform one.
Figure 2A:
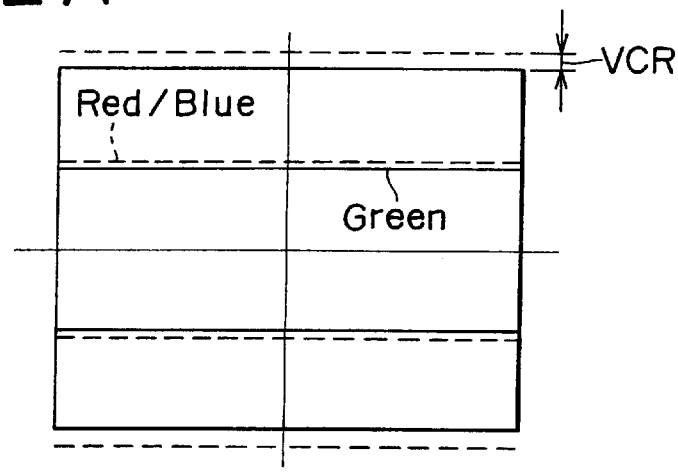
FIG. 2A is an explanatory diagram of vertical misconvergence induced on the screen of a cathode ray tube when the vertical deflection magnetic field is a barrel one.
Figure 2B:
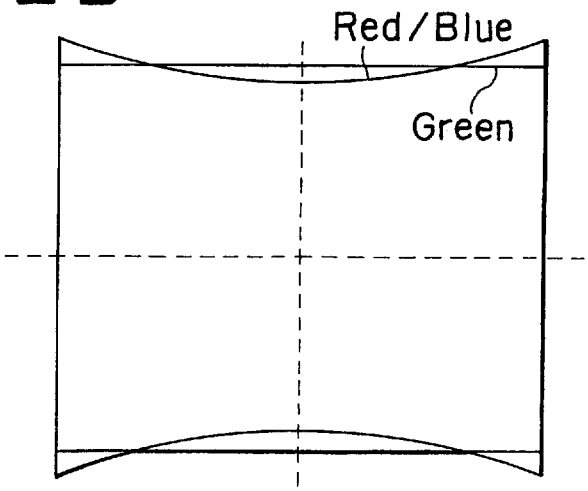
FIG. 2B shows an exemplary pattern of ΔVCR induced on the screen of a cathode ray tube.
Figure 3A:
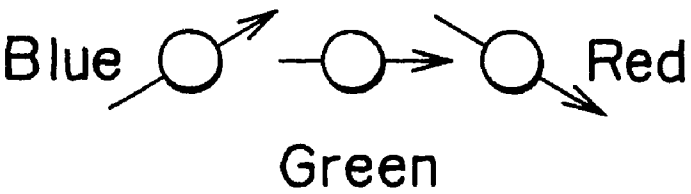
FIG. 3A shows magnetic fields impressed to in-line electron beams when the electron beams are deflected toward the upper end of the screen along its Y-axis, illustrating a state seen from the screen side.
Figure 3B:
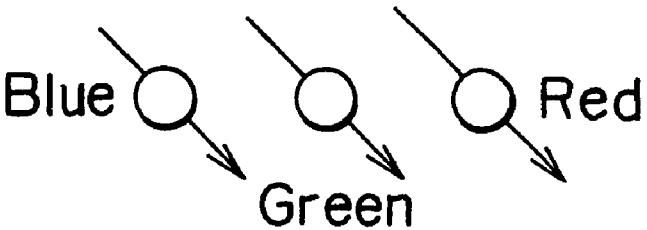
FIG. 3B shows magnetic fields impressed to in-line electron beams when the electron beams are deflected toward the upper right end of the screen, illustrating a state seen from the screen side.

This signifies that the pattern shown in FIG. 2B is corrected. Thus, it becomes possible to correct ΔVCR independently.

The shifts of the side beams R, B shown in FIG. 15 can be reversed with facility by inverting the direction of the sextuple-pole current or by changing the winding direction of the sextuple pole coils 30, 31.

According to the present invention, as described above, a horizontal deflection-period parabolic current modulated at the vertical deflection period can be caused to flow in a sextuple-pole magnetic field generating means which exerts vertical force on three electron beams.

More specifically, ΔVCR can be corrected independently by the sextuple-pole magnetic field generating means.

Further, in determining the winding distribution of a vertical deflection coil or a horizontal deflection coil, it becomes possible to eliminate the necessity of taking ΔVCR into consideration.

That is, both the focus characteristic and the convergence characteristic are rendered compatible due to the enhanced degree of freedom in the winding distribution of the deflection coil.

Although the present invention has been mentioned hereinabove with reference to some preferred embodiments thereof, it is to be understood that the invention is not limited to such embodiments alone, and a variety of other changes and modifications will be apparent to those skilled in the art without departing from the spirit of the invention.

What is claimed is:

1. A deflection yoke comprising:

parabolic current producing means for producing a horizontal-period parabolic current and supplying such a parabolic current to a convergence correcting coil;

sextuple-pole magnetic field generating means disposed around the orbits of three electron beams emitted from an electron gun, and exerting vertical force on the three electron beams by a sextuple pole magnetic field generated in accordance with the horizontal-period parabolic current supplied from said parabolic current producing means; and modulating means for modulating, at the vertical period, the horizontal-period parabolic current flowing in said sextuple-pole magnetic field generating means.

2. The deflection yoke according to claim 1, wherein said parabolic current producing means is a bridge circuit consisting of a saturable reactor in which a horizontal deflection current is caused to flow.

3. The deflection yoke according to claim 1 or 2, wherein said modulating means consists of two saturable reactors in which a vertical deflection current is caused to flow, and a composite value of the horizontal-period parabolic currents modulated respectively by said saturable reactors is modulated at the vertical period.

4. The deflection yoke according to claim 3, wherein the horizontal-period parabolic currents modulated respectively by said saturable reactors are caused to flow in mutually independent sextuple-pole magnetic field generating means.

5. The deflection yoke according to claim 4, wherein each of said mutually independent sextuple-pole magnetic field generating means consists of two sets of sextuple pole coils which are formed of bifilar windings.

6. A color cathode ray tube receiver using a deflection yoke which comprises:

parabolic current producing means for producing a horizontal-period parabolic current and supplying such a parabolic current to a convergence correcting coil;

sextuple-pole magnetic field generating means disposed around the orbits of three electron beams emitted from an electron gun, and exerting vertical force on the three electron beams by a sextuple pole magnetic field generated in accordance with the horizontal-period parabolic current supplied from said parabolic current producing means; and modulating means for modulating, at the vertical period, the horizontal-period parabolic current flowing in said sextuple-pole magnetic field generating means.

7. The color cathode ray tube receiver according to claim 6, wherein said parabolic current producing means is a bridge circuit consisting of a saturable reactor in which a horizontal deflection current is caused to flow.

8. The color cathode ray tube receiver according to claim 6 or 7, wherein said modulating means consists of two saturable reactors in which a vertical deflection current is caused to flow, and a composite value of the horizontal-period parabolic currents modulated respectively by said saturable reactors is modulated at the vertical period.

9. The color cathode ray tube receiver according to claim 8, wherein the horizontal-period parabolic currents modulated respectively by said saturable reactors are caused to flow in mutually independent sextuple-pole magnetic field generating means.

10. The color cathode ray tube receiver according to claim 9, wherein each of said mutually independent sextuple-pole magnetic field generating means consists of two sets of sextuple pole coils which are formed of bifilar windings.

* * * * *

UNITED STATES PATENT AND TRADEMARK OFFICE

CERTIFICATE OF CORRECTION

PATENT NO. : 6,359,397 B1
DATED : March 19, 2002
INVENTOR(S) : Kyousuke Aoki

It is certified that error appears in the above-identified patent and that said Letters Patent is hereby corrected as shown below:

Title page,
Insert Item:

-- [30] Foreign Application Priority Data:

Nov. 19, 1999 (JP)……...P11-329142
Oct. 4, 2000 (JP)……P2000-304491 --

Signed and Sealed this

Twenty-ninth Day of April, 2003

JAMES E. ROGAN
*Director of the United States Patent and Trademark Office*